US008096678B2

(12) United States Patent
Jones, III et al.

(10) Patent No.: US 8,096,678 B2
(45) Date of Patent: Jan. 17, 2012

(54) SYSTEM, METHOD AND APPARATUS FOR BACKLIT DISPLAY ON APPLIANCES AND EQUIPMENT

(75) Inventors: Harold Glenn Jones, III, Austin, TX (US); John W. Worsham, III, Austin, TX (US)

(73) Assignee: Texas Lightsmith, Inc, Austin, TX (US)

( * ) Notice: Subject to any disclaimer, the term of this patent is extended or adjusted under 35 U.S.C. 154(b) by 371 days.

(21) Appl. No.: 12/417,070

(22) Filed: Apr. 2, 2009

(65) Prior Publication Data

US 2010/0254125 A1 Oct. 7, 2010

(51) Int. Cl.
*F21V 33/00* (2006.01)

(52) U.S. Cl. ..... 362/234; 362/311.03; 362/311.13; 362/253; 362/367

(58) Field of Classification Search ..... 362/234, 362/154, 156, 132, 133, 134, 253, 367, 311.01, 362/311.13
See application file for complete search history.

(56) References Cited

U.S. PATENT DOCUMENTS 1,771,415 A * 7/1930 Neuner ..... 362/234
4,557,517 A * 12/1985 Bolduc et al. ..... 362/485
4,674,211 A 6/1987 Pratt
5,523,930 A 6/1996 Fritts
5,544,024 A * 8/1996 Wittern et al. ..... 362/89
5,649,757 A * 7/1997 Aleman et al. ..... 362/101
5,761,838 A 6/1998 Chisholm et al.
5,943,801 A 8/1999 Wilkinson
6,154,895 A 12/2000 Pisklak
6,253,489 B1 * 7/2001 Sung et al. ..... 47/65.7
6,539,561 B2 4/2003 Shimizu
6,805,458 B2 10/2004 Schindler et al.
7,008,073 B2 3/2006 Stuhlmacher, II
7,377,661 B2 5/2008 Douglass
7,434,960 B2 10/2008 Stuhlmacher, II et al.
7,445,353 B2 * 11/2008 Fiene ..... 362/133
2004/0179351 A1 9/2004 Patterson
2008/0163985 A1 7/2008 MacKaig

OTHER PUBLICATIONS

Texas Light Smith, www.texaslightsmith.com/index.php.

* cited by examiner

*Primary Examiner* — Laura Tso

(57) ABSTRACT

A backlit display for sink and vent hood assemblies is disclosed. The assembly has a body with an interior and an exterior with a front and sides. A frame is mounted to the front of the body and defines a window. A support panel is installed in the frame and has a light. A mounting bezel is mounted to the frame in front of the window. The mounting bezel defines a pocket between the mounting bezel and the frame. The assembly also comprises a decorative panel that is mounted in the pocket between the mounting bezel and the frame in front of the window. The light backlights and illuminates the decorative panel in front of and away from the body through the window.

25 Claims, 6 Drawing Sheets

SYSTEM, METHOD AND APPARATUS FOR BACKLIT DISPLAY ON APPLIANCES AND EQUIPMENT

BACKGROUND OF THE INVENTION

1. Technical Field

The present invention relates in general to light fixtures and, in particular, to an improved system, method and apparatus for a backlit display for appliances and equipment, such as kitchen sinks and vent hoods.

2. Description of the Related Art

Sinks, vent hoods and other appliances and equipment are commonly used in kitchens. The front portions of sinks, for example, are usually constructed out of the same materials as the body of the sink. Typically, any decoration or ornamentation added to the front of a metal sink is in the form of a hammered, formed, or woven metal strip design. Ceramic sinks also are known and typically have a smooth, flat front or a simple embossed design. Although each of these designs is workable and attractive for some applications, an improved system, method and apparatus for displays on appliances and equipment, such as kitchen sinks and vent hoods, would be desirable.

SUMMARY OF THE INVENTION

Embodiments of a system, method, and apparatus for a backlit display for equipment and appliances, such as sink and vent hood assemblies, are disclosed. In one embodiment, the assembly comprises a body having an interior and an exterior with a front and sides. A frame is mounted to the front of the body and defines a window. A support panel is installed in the frame and has a light mounted thereto. A mounting bezel is mounted to the frame in front of the window. The mounting bezel defines a pocket between the mounting bezel and the frame.

The assembly also comprises a decorative panel that is mounted in the pocket between the mounting bezel and the frame in front of the window in the frame. When the light is activated, it backlights and illuminates the decorative panel in front of and away from the body through the window of the frame. In some embodiments, the light comprises cold cathode fluorescent lights with ballasts that are mounted to the support panel.

The invention has numerous advantages over prior art designs. The decorative panel may be formed from translucent material such as a woven metal that is light-permeable, plastic or glass materials. The decorative panel also is replaceable, or may be provided with inserts for theme-specific entertaining. The panel may be replaced on-site with a minimum amount of skill and tools. The backlighting also can be of a color-changing nature, animated effects or a scrolling marquee. Moreover, displays constructed in accordance with the invention may be integrated into home lighting control systems as a component of the home's overall lighting scheme.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Figure 1:
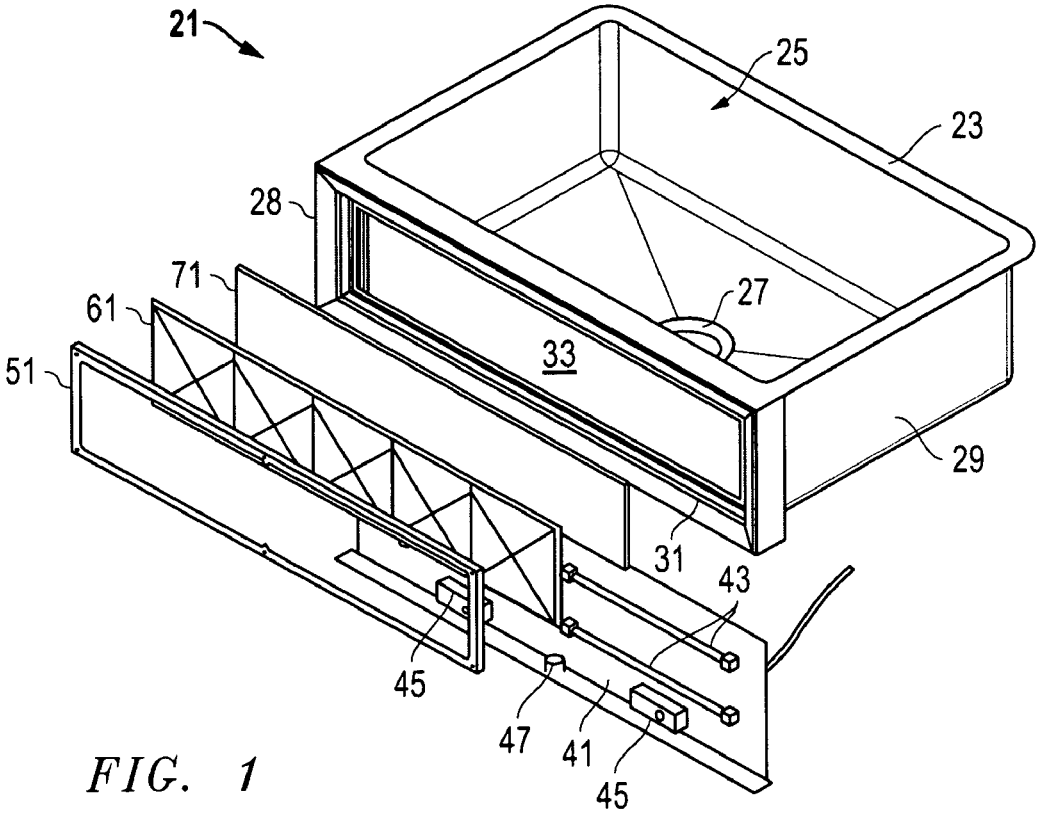
FIG. 1 is an exploded isometric view of one embodiment of a backlit display for a sink assembly and is constructed in accordance with the invention.
Figure 2:
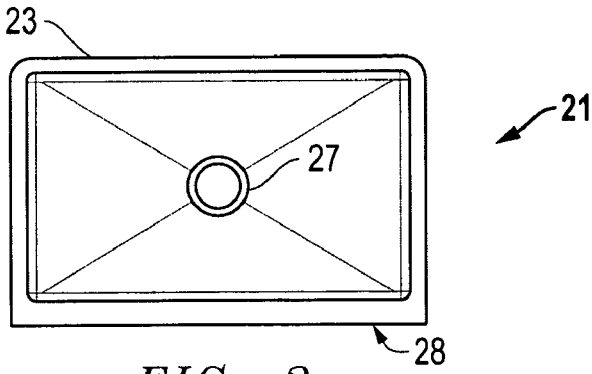
FIG. 2 is a top view of one embodiment of the sink assembly of FIG. 1 and is constructed in accordance with the invention.
Figure 3:
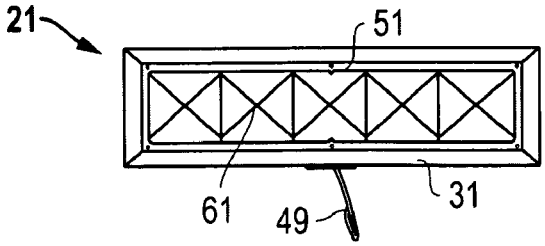
FIG. 3 is a front view of one embodiment of the sink assembly of FIG. 1 and is constructed in accordance with the invention.
Figure 4:
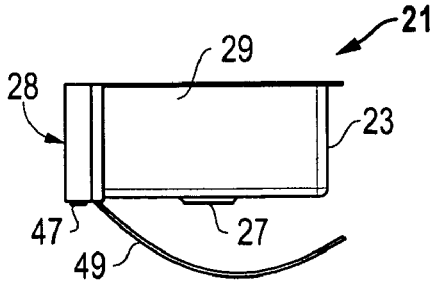
FIG. 4 is a side view of one embodiment of the sink assembly of FIG. 1 and is constructed in accordance with the invention.
Figure 6:
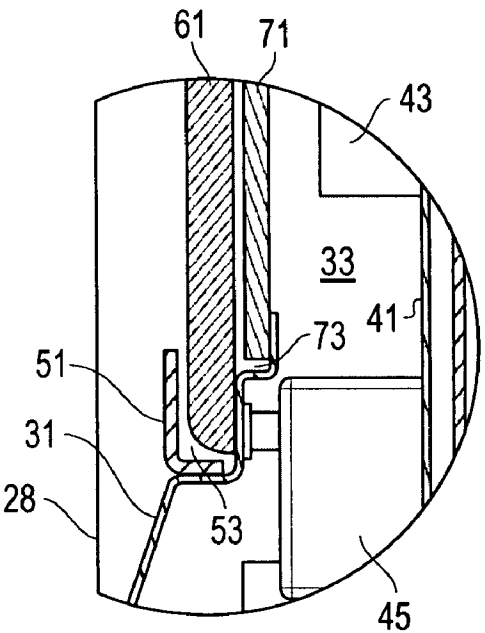
FIG. 6 is an enlarged sectional side view of a portion of one embodiment of the sink assembly of FIG. 1 and is constructed in accordance with the invention.

Referring to FIGS. 1-15, embodiments of a system, method and apparatus for a backlit display for a sink and vent hood are shown. For example, FIGS. 1-6 depict embodiments comprising a sink assembly 21. The sink assembly 21 includes a body or basin 23 having an interior 25 with a drain 27 and an exterior with a front 28 and sides 29. A frame 31 is mounted to the front 28 of the basin 23 and extends between the sides 29. The frame may be mounted to the body by welding, soldering, rivets, screws and the like. The frame 31 defines a window 33 (FIG. 1) and has an opening 35 (FIG. 5) on a lower end thereof.

Figure 5:
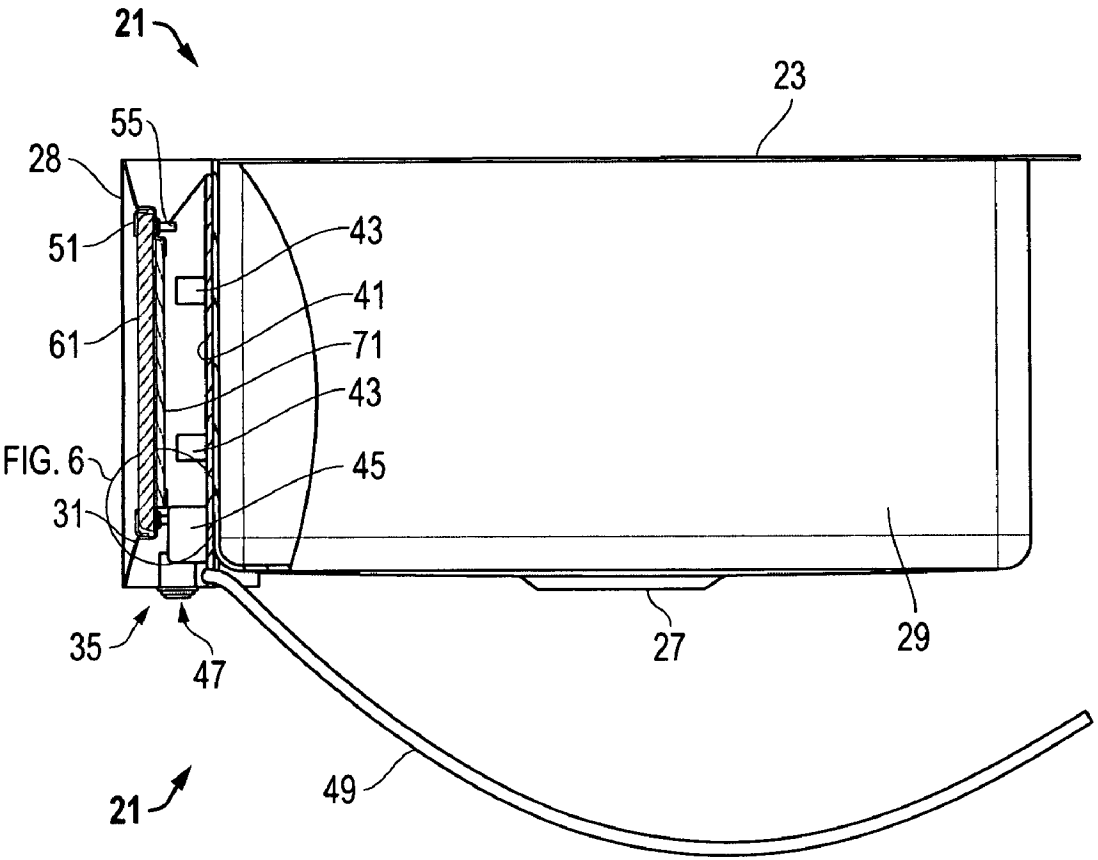
FIG. 5 is a sectional side view of one embodiment of the sink assembly of FIG. 1 and is constructed in accordance with the invention.

A support panel 41 is installed in the frame 31, and may be installed through the lower end 35 thereof. The support panel 41 has a light, such as a plurality of cold cathode fluorescent lights 43 and fluorescent ballasts 45 or power supplies. The support panel 41 may further comprise an on/off switch 47 on a lower surface thereof, and a power cord 49 extending therefrom. A mounting bezel 51 is mounted to the frame 31 in front of the window 33. The mounting bezel 51 defines a pocket 53 (FIG. 6) between the mounting bezel 51 and the frame 31. The mounting bezel 51 may be secured to the frame 31 with more or fewer sealed fasteners 55 (FIG. 5).

The sink assembly 21 further comprises a decorative panel 61 that is mounted in the pocket 53 between the mounting bezel 51 and the frame 31 in front of the window 33 in the frame 31. The decorative panel 61 may comprise a translucent light diffuser. The decorative panel also may comprise a non-translucent mask on the front to allow light to come through only in selected spots, such as a backlit stencil design, a backlit punched design, a metal weave, etc. When activated, the cold cathode fluorescent lights 43 backlight and illuminate the decorative panel 61 in front of and away from the sink basin 23 through the window 33 of the frame 31.

In some embodiments, the sink assembly 21 may further comprise a seal panel 71 mounted in the pocket 53 (FIG. 6) between the decorative panel 61 and the window 33 for providing a water seal for the support panel 41 and its electrical components. The seal panel 71 may comprise clear glass so as to not impede the light from lights 43. In other embodiments, one or more additional decorative diffusers may be integrated into the design to create multi-layered decorative patterns.

Figure 12:
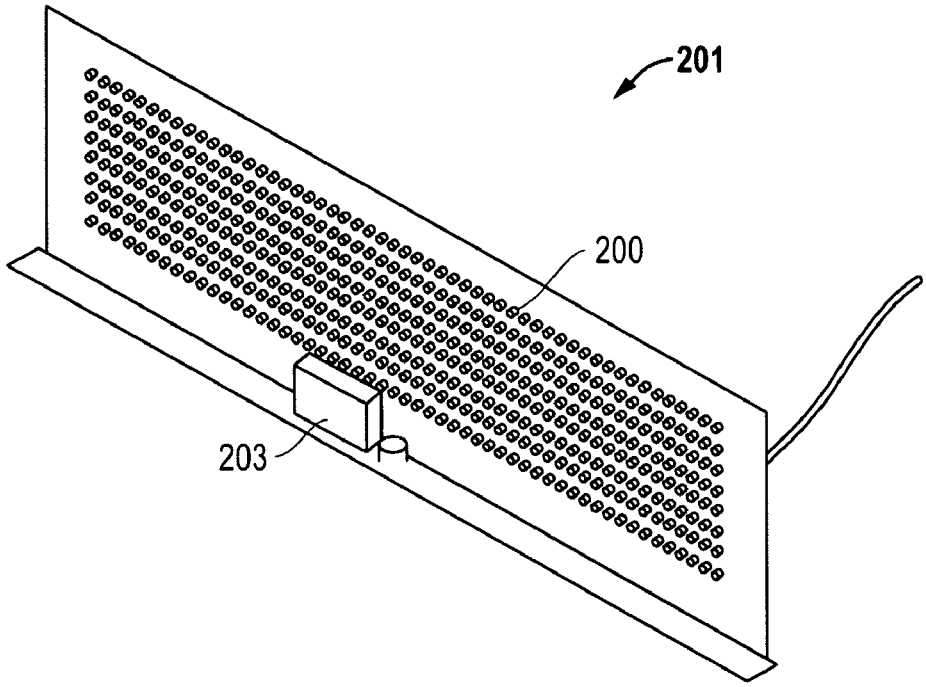
FIGS. 12-14 are isometric views of other alternate embodiments of decorative panels constructed in accordance with the invention.
Figure 13:
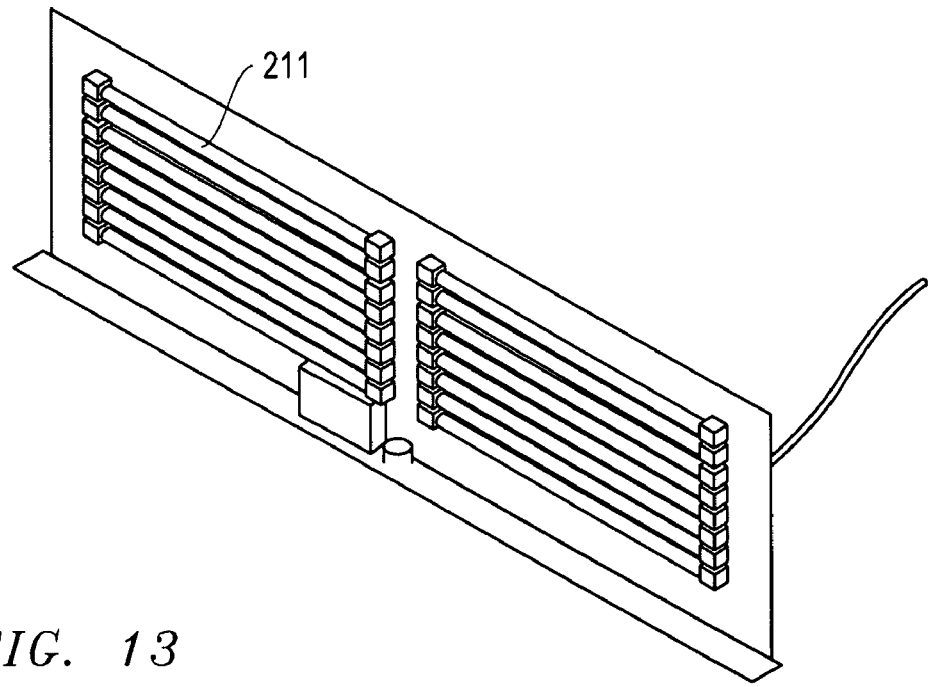
Figure 14:
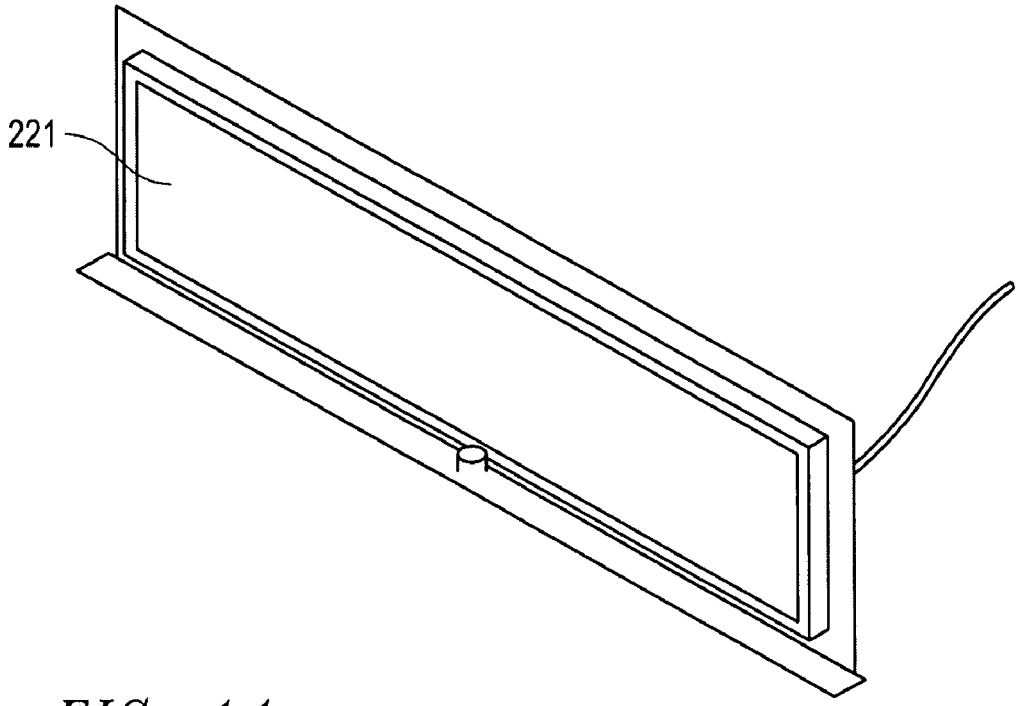

In still other embodiments, the backlighting also may comprise a color-changing sequence, animated effects and/or a scrolling marquee. For example, as shown in FIG. 12, the lights 200 (e.g., an array of multi-colored LEDs) in one embodiment of decorative panel 201 may be provided with a control system 203 (e.g., computer and software) that changes the colors of the lights through a sequence of different colors. Alternatively, an animated panel may be displayed by switching the lights on and off in a particular timed sequence, such as with an array of multi-colored cold cathode fluorescent lights 211 (FIG. 13).

The animation also may be realized by embodiments that use a computer and monitor 221 (FIG. 14), such as a computer and LCD screen monitor. Moreover, displays constructed in accordance with the invention may be integrated into home lighting control systems as a component of the home's overall lighting scheme. Such screen may be equipped with controls and software that permit touch-screen operation by the user. Among other uses, it could display photos, screen saver type graphics with motion, a daily schedule with alarms or reminders, oven timer, recipe database, house control system (such as lights, house alarm, ceiling fans etc.), weather forecast, news feeds, and television. Like any modern computer, it could use wi-fi, bluetooth, or any other wireless communication format. It also may be equipped with a microphone and speakers (e.g., on the left and right sides) for voice synthesis and speech recognition. Appropriate waterproofing with gaskets, etc., may be used, but the computer itself may itself be waterproof on the front where it is exposed.

In the illustrated embodiment of FIGS. 1 and 5, the seal panel 71 is smaller than the decorative panel 61 and installed on ledges 73 in the pocket 53. The seal panel 71 may be centered relative to the decorative panel 61 and spaced apart from the decorative panel 61 such that the seal panel 71 is free of contact with the decorative panel 61. Furthermore, the illustrated embodiment depicts each of the basin 23, frame 31, support panel 41, mounting bezel 51, decorative panel 61 and seal panel 71 as being rectangular in shape. The shapes of the invention may be varied, however, such as with non-linear designs that incorporate curves, waves or still other shapes.

Figure 7:
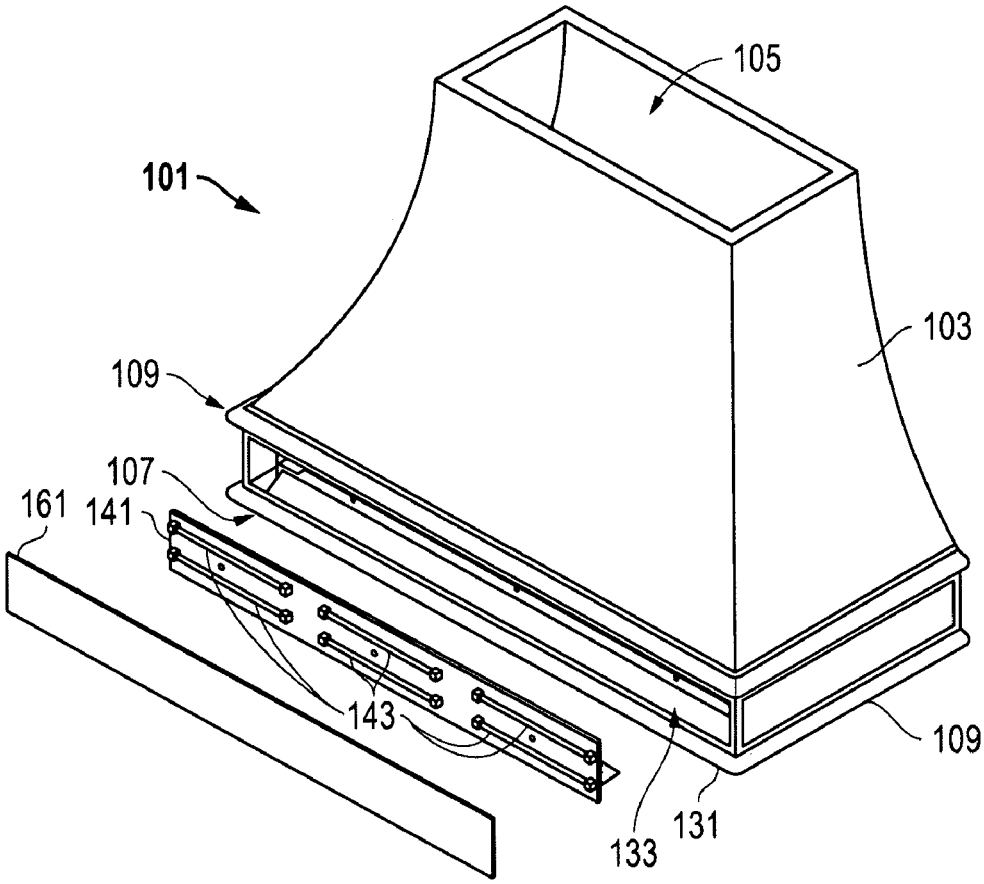
FIG. 7 is an exploded isometric view of one embodiment of a backlit display for a vent hood assembly and is constructed in accordance with the invention.
Figure 8:
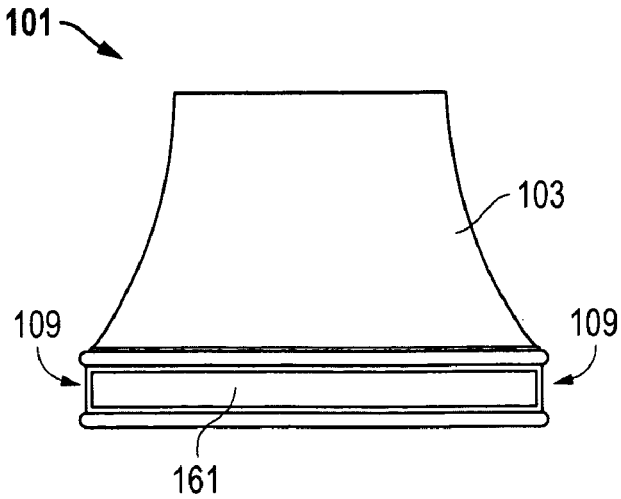
FIG. 8 is a front view of one embodiment of the vent hood assembly of FIG. 7 and is constructed in accordance with the invention.
Figure 9:
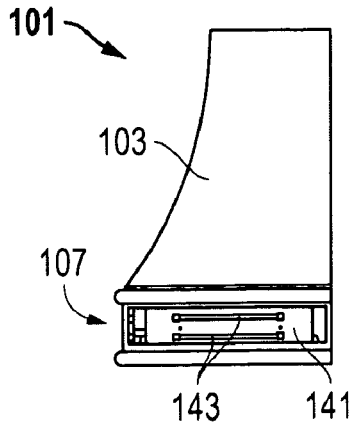
FIG. 9 is an exposed side view of one embodiment of the vent hood assembly of FIG. 7 and is constructed in accordance with the invention.
Figure 11:
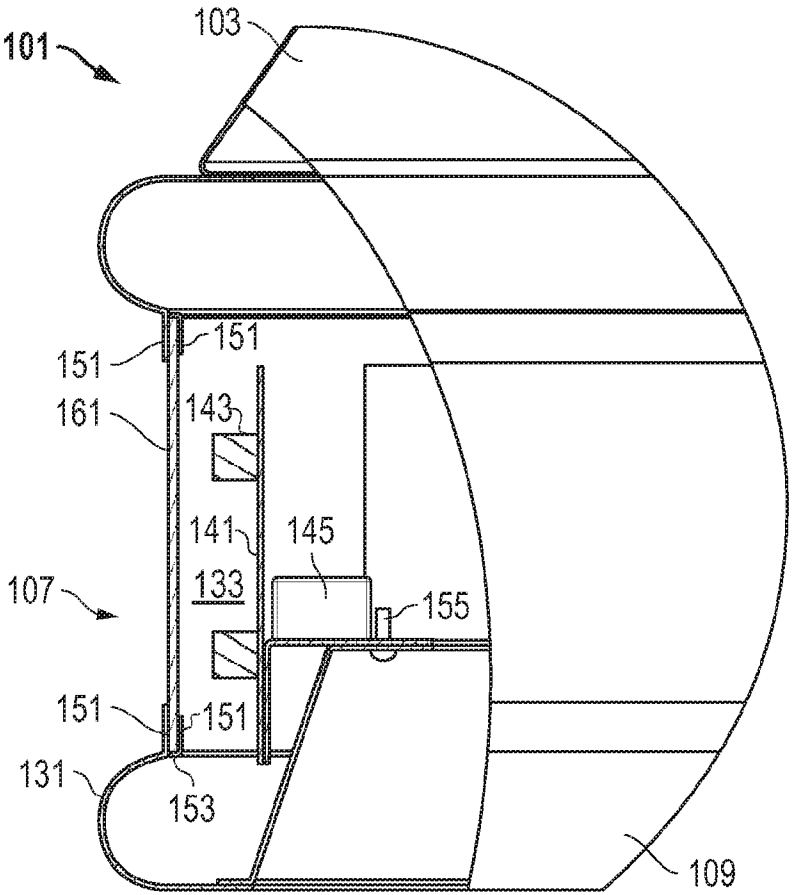
FIG. 11 is an enlarged sectional side view of a portion of one embodiment of the vent hood assembly of FIG. 7 and is constructed in accordance with the invention.
Figure 10:
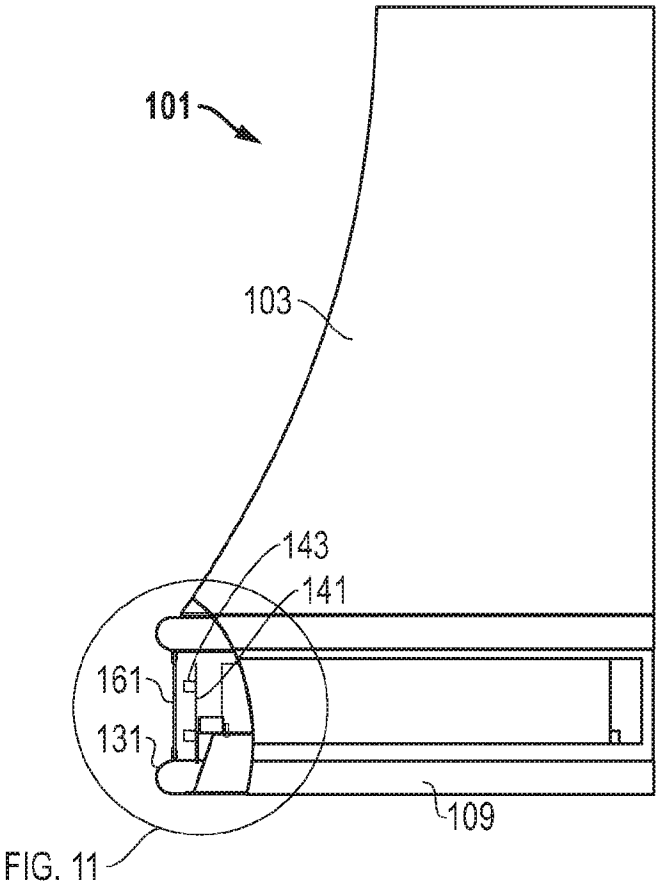
FIG. 10 is a partially-sectioned side view of one embodiment of the vent hood assembly of FIG. 7 and is constructed in accordance with the invention.

Referring now to FIGS. 7-11, other embodiments of the invention comprise a vent hood assembly 101, such as those located above stoves or ovens in kitchens. The vent hood assembly 101 comprises a body or plenum 103 having an interior 105 (FIG. 5) for drawing air therethrough and an exterior with a front 107 and sides 109. A frame 131 is mounted to the front 107 of the plenum 103 and extends between the sides 109. The frame defines a window 133 (FIGS. 7 and 11).

The vent hood assembly 101 also comprises a support panel 141 installed in the frame 131 with, e.g., fasteners 155. The support panel 141 has a plurality of lights or cold cathode fluorescent lights 143 and fluorescent ballasts or power supplies 145. A mounting bezel, comprising a set of flanges 151 (FIG. 11) extend from the frame 131 in the embodiment shown, and are mounted to the frame 131 in front of the window 133. The flanges 151 of the mounting bezel define a pocket 153 between the mounting bezel and inner portions of the frame 131.

Like the preceding embodiments, the vent hood assembly 101 also has a decorative panel 161 mounted in the pocket 153 in front of the window 133 in the frame 131. When activated, the cold cathode fluorescent lights 143 backlight and illuminate the decorative panel 161 in front of and away from the plenum 103 through the window 133 of the frame 131. The various embodiments of the decorative panels described herein may be incorporated into these vent hoods as well as other appliances and equipment.

In still another embodiment, the vent hood assembly 101 may farther comprise one or more side light assemblies. The side light assemblies are substantially identical to but smaller than the front light assembly described above for the vent hood, except that they are mounted on the sides of the plenum instead of the front. For example, the side light assemblies have side frames with a side window. The side frame is mounted to one of the sides of the plenum. A side support panel 141 (FIG. 9) is installed in the side frame and has a light(s) 143. A side mounting bezel is mounted to the side frame and defines a side pocket between the side mounting bezel and the side frame. A decorative panel 161 (FIG. 7) is mounted in the side pocket between the side mounting bezel and the side frame, such that, when activated, the lights backlight and illuminate the side decorative panel to said one of the sides of the plenum.

Figure 15:
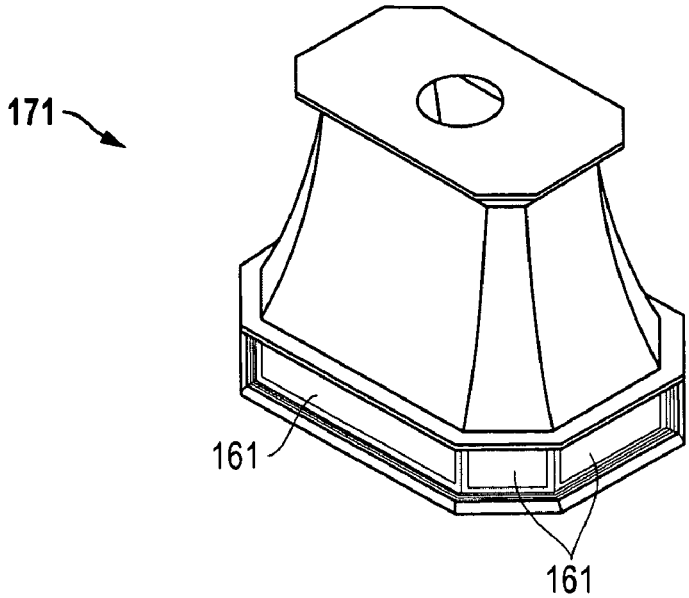
FIG. 15 is an isometric view of an alternate embodiment of a vent hood assembly constructed in accordance with the invention.

FIG. 15 depicts yet another alternate embodiment of the invention comprising a multi-sided vent hood assembly 171 that is well suited for placement above a kitchen island. Kitchen island vent hoods may incorporate the various types of decorative panels 161 and lighting designs described herein around their entire perimeters as shown, such as all of the sides of an island vent hood, regardless of shape. The illustrated embodiment is shown with eight sides, but may comprise more of fewer sides, or non-rectangular shapes as well.

In a more generic embodiment, the invention may be characterized as an appliance comprising a body having an interior and an exterior with a front and sides; a frame mounted to the front of the body and defining a window; a support panel installed in the frame and having a light mounted thereto; a mounting bezel mounted to the frame in front of the window, the mounting bezel defining a pocket between the mounting bezel and the frame; a decorative panel mounted in the pocket between the mounting bezel and the frame in front of the window in the frame, such that, when activated, the light backlights and illuminates the decorative panel in front of the body through the window of the frame.

As described herein, for example, the appliance may be a sink, the body may be a basin with a drain, and the frame may be provided with an opening on a lower end thereof, with the support panel installed through and mounted in the lower end of the frame. The light may comprise a plurality of cold cathode fluorescent lights and fluorescent ballasts or power supplies, which also are mounted to the support panel.

While the invention has been shown or described in only some of its forms, it should be apparent to those skilled in the art that it is not so limited, but is susceptible to various changes without departing from the scope of the invention.

We claim:

1. A kitchen appliance, comprising:

a kitchen appliance body having an interior and an exterior with a front and sides;

a frame mounted to the front of the body and defining a window;

a support panel installed in the frame and having a light mounted thereto;

a mounting bezel mounted to the frame in front of the window, the mounting bezel defining a pocket;

a decorative panel mounted in the pocket in front of the window in the frame, such that, when activated, the light backlights and illuminates the decorative panel in front of the body through the window of the frame.

2. A kitchen appliance according to claim 1, wherein the kitchen appliance is a sink, the kitchen appliance body is a basin with a drain, the frame has an opening on a lower end thereof, and the support panel is installed through and mounted in the lower end of the frame.

3. A kitchen appliance according to claim 1, wherein the kitchen appliance is a vent hood and the body is a plenum.

4. A kitchen appliance according to claim 1, wherein the light comprises a plurality of cold cathode fluorescent lights and fluorescent ballasts also mounted to the support panel.

5. A kitchen appliance according to claim 1, wherein the mounting bezel is a set of flanges extending from the frame, and the decorative panel further comprises a non-translucent mask that permits selective light permeability.

6. A kitchen appliance according to claim 1, wherein the light has a control system that changes and animates a color of the light through a sequence of different colors, and switching lights on and off in a timed sequence.

7. A kitchen appliance according to claim 1, wherein the light comprises a plurality of lights comprising one of multi-colored LEDs, multi-colored cold cathode fluorescent lights, and a computer with an LCD screen.

8. A kitchen appliance according to claim 1, wherein the light is integrated into a home lighting control system as a component of an overall lighting scheme of the home.

9. A kitchen appliance according to claim 1, further comprising at least one additional diffuser that is integrated into the kitchen appliance to create a multi-layered decorative pattern.

10. A sink assembly, comprising:

a basin having an interior with a drain and an exterior with a front and sides;

a frame mounted to the front of the basin and extending between the sides, the frame defining a window and having an opening on a lower end thereof;

a support panel installed in the frame, the support panel having a plurality of lights;

a mounting bezel mounted to the frame in front of the window, the mounting bezel defining a pocket between the mounting bezel and the frame;

a decorative panel mounted in the pocket between the mounting bezel and the frame in front of the window in the frame, such that, when activated, the lights backlight and illuminate the decorative panel in front of and away from the sink through the window of the frame.

11. A sink assembly according to claim 10, wherein the support panel further comprises an on/off switch on a lower surface thereof, and a power cord extending therefrom, and the lights comprise cold cathode fluorescent lights with fluorescent ballasts and a power supply.

12. A sink assembly according to claim 10, wherein the mounting bezel is secured to the frame with sealed fasteners, the decorative panel is a translucent light diffuser, and the decorative panel further comprises a non-translucent mask that permits selective light permeability.

13. A sink assembly according to claim 10, further comprising a seal panel mounted in the pocket between the decorative panel and the window for providing a water seal for the support panel.

14. A sink assembly according to claim 13, wherein the seal panel is clear glass, and the seal panel is smaller than the decorative panel and installed on ledges in the pocket such that the seal panel is centered relative to the decorative panel and spaced apart from the decorative panel such that the seal panel is free of contact with the decorative panel.

15. A sink assembly according to claim 14, wherein each of the basin, frame, support panel, mounting bezel, decorative panel and the seal panel is rectangular in shape.

16. A sink assembly according to claim 10, wherein the lights have a control system that changes and animates colors of the lights through a sequence of different colors, and switching lights on and off in a timed sequence.

17. A sink assembly according to claim 10, wherein the lights comprise one of multi-colored LEDs, multi-colored cold cathode fluorescent lights, and a computer with an LCD screen.

18. A sink assembly according to claim 10, wherein the lights are integrated into a home lighting control system as a component of an overall lighting scheme of the home.

19. A sink assembly according to claim 10, wherein the lights comprise a computer and LCD screen monitor with touch-screen control operation for a user, a wireless communication format, a microphone and speakers for voice synthesis and speech recognition.

20. A vent hood assembly, comprising:

a plenum having an interior for drawing air therethrough and an exterior with a front and sides;

a frame mounted to the front of the plenum and extending between the sides, the frame defining a window;

a support panel installed in the frame and having a plurality of lights;

a mounting bezel mounted to the frame in front of the window, the mounting bezel defining a pocket between the mounting bezel and the frame; and a decorative panel mounted in the pocket between the mounting bezel and the frame in front of the window in the frame, such that, when activated, the lights backlight and illuminate the decorative panel in front of and away from the plenum through the window of the frame.

21. A vent assembly according to claim 20, wherein the mounting bezel is a set of flanges extending from the frame, and the decorative panel further comprises a non-translucent mask that permits selective light permeability.

22. A vent hood assembly according to claim 20, further comprising a side frame having a side window, the side frame being mounted to one of the sides of the plenum, a side support panel installed in the side frame and having a light, a side mounting bezel mounted to the side frame and defining a side pocket between the side mounting bezel and the side frame, and a decorative panel mounted in the side pocket between the side mounting bezel and the side frame, such that, when activated, the light backlights and illuminates the side decorative panel to said one of the sides of the plenum.

23. A vent hood assembly according to claim 20, further comprising a plurality of side frames each having side windows, each mounted to a respective one of the sides of the plenum, side support panels installed in respective ones of the side frames, each side support panel having lights, side mounting bezels mounted to respective ones of the side frames external to the side windows, the side mounting bezels defining side pockets between the side mounting bezels and the side frames, and decorative panels mounted in respective ones of the side pockets between the side mounting bezels and the side frames external to the side windows in the side frames, such that, when activated, the lights backlight and illuminate the side decorative panels to the sides of and away from the plenum through the side windows of the side frames; and wherein the support panel further comprises an on/off switch on a lower surface thereof, a power cord extending therefrom, and wherein the mounting bezel is secured to the frame with sealed fasteners, and the decorative panel is a translucent light diffuser.

24. A vent hood assembly according to claim 20, further comprising a seal panel mounted in the pocket between the decorative panel and the window for providing a water seal for the support panel; wherein the seal panel is clear glass, and the seal panel is smaller than the decorative panel and installed on ledges in the pocket such that the seal panel is centered relative to the decorative panel and spaced apart from the decorative panel such that the seal panel is free of contact with the decorative panel; and wherein each of the basin, frame, support panel, mounting bezel, decorative panel and the seal panel is rectangular in shape.

25. A vent hood assembly according to claim 20, wherein the lights have a control system that changes and animates colors of the lights through a sequence of different colors, and switching lights on and off in a timed sequence;

the lights comprise one of multi-colored LEDs, multi-colored cold cathode fluorescent lights, and an LCD screen; and the lights are integrated into a home lighting control system as a component of an overall lighting scheme of the home.

* * * * *